United States Patent [19]

Heilweil

[11] 4,012,315

[45] Mar. 15, 1977

[54] TRAP TO REMOVE METALS UTILIZING A SULFUR MODIFIED SUBSTRATE AND ELECTROPHORESIS

[75] Inventor: Israel J. Heilweil, Princeton, N.J.

[73] Assignee: Mobil Oil Corporation, New York, N.Y.

[22] Filed: Oct. 31, 1975

[21] Appl. No.: 627,723

Related U.S. Application Data

[63] Continuation of Ser. No. 321,116, Jan. 4, 1973, abandoned.

[52] U.S. Cl. ..... 208/253

[51] Int. Cl.[2] ..... C10G 29/04

[58] Field of Search ..... 208/253

[56] References Cited

UNITED STATES PATENTS

| | | | |
|---|---|---|---|
| 2,540,129 | 2/1951 | Laner et al. | 208/253 |
| 2,781,297 | 2/1957 | Appell | 208/253 |
| 3,011,973 | 12/1961 | Bradbury et al. | 208/253 |
| 3,933,624 | 1/1976 | Myers | 208/253 |

OTHER PUBLICATIONS

Weast et al., *Handbook of Chemistry & Physics,* 49th ed., Chem. Rubber Co., Cleveland, Ohio, 1968, p. D–86.

T. Mueller, *Inorganic Chemistry*, John Wiley & Sons, N.Y., 1952, pp. 284–290.

*Primary Examiner*—Delbert E. Gantz
*Assistant Examiner*—James W. Hellwege
*Attorney, Agent, or Firm*—Charles A. Huggett; Vincent J. Frilette; Michael G. Gilman

[57] ABSTRACT

Sulfur is deposited on a solid substrate. Metal compounds containing sulfur reaction products produced when hydrocarbon streams contaminated with the metals are contacted with the sulfur modified substrate are removed by electrophoresis.

5 Claims, 3 Drawing Figures

FIG.1
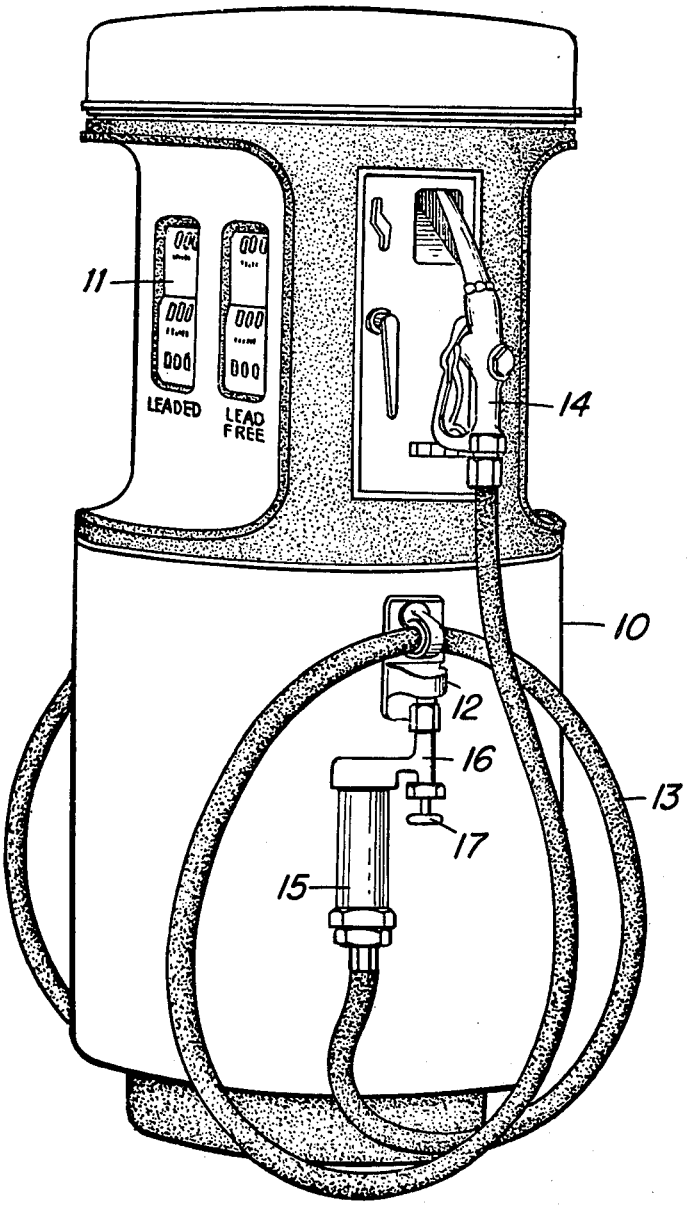
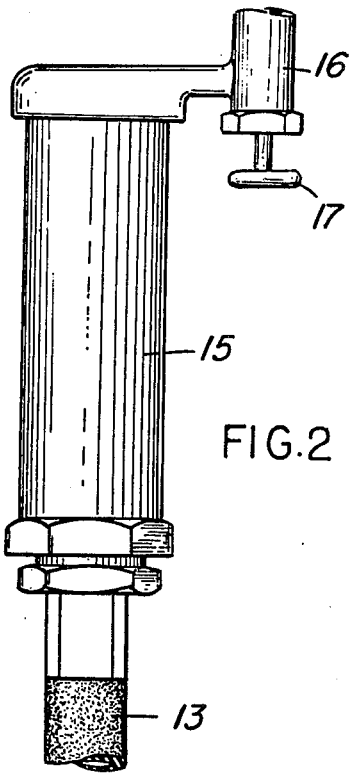
FIG.2
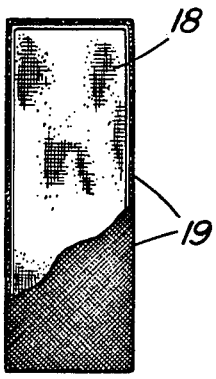
FIG.3

TRAP TO REMOVE METALS UTILIZING A SULFUR MODIFIED SUBSTRATE AND ELECTROPHORESIS

This application is a continuation of application Ser. No. 321,116 filed Jan. 4, 1973 now abandoned.

BACKGROUND OF THE INVENTION

1. Field of the Invention

This invention deals with the removal of metals such as lead, cadmium, mercury, arsenic, zinc, chromium, tin iron and cobalt from compositions containing such metals as organic and inorganic compounds. The need for the removal of such metals is evidenced by the fact that their presence in hydrocarbon charge stocks conducted to catalytic cracking and catalytic reforming units is known to poison and shorten the life of the catalyst with which such metal contaminated stocks come into contact.

It is also desirable to remove trace metals from lubricating oils or to recover soluble metal catalysts from reactor effluents of polymer solutions. The removal of heavy metals such as mercury, silver, cadmium and the like from the water effluents of chemical, electrolysis, metal deposition or photographic plants is also highly desired from an ecological standpoint.

It is known that residues of alkyl lead moieties from combustion of leaded gasoline tend to poison catalysts available for cleaning automotive exhaust gases by the catalytic oxidation of carbon monoxide and unburned hydrocarbons in the exhaust. Such poisoning severely shortens the useful life of exhaust combustion catalysts. It has thus been heretofore proposed that substantially metal-free, and primarily substantially lead-free gasoline be supplied for use in automobiles equipped with emission control devices which utilize catalysts to help further oxidize exhaust gases.

The normal network of petroleum product distribution involves railroad tank cars, pipelines, water borne tankers, tank trucks and bulk storage tanks. For commercial operation these are presently set up to handle different products. For example, the same pipeline might be used to convey a shipment of regular grade gasoline, premium grade gasoline, distillate fuel and other light liquid products in succession. According to present procedures, that portion of the fluids carried by the pipeline which constitutes an intermingling of the two products at their interface will be diverted to storage for the lower grade product, thus avoiding degradation of the higher grade product.

However, when leaded and/or when metal containing gasoline is followed by metal-free gasoline, not just the interface comprising an intermingling of the two products, but the entire lead-free shipment becomes degraded. When leaded gasoline, containing tetraethyl lead, tetramethyl lead or a mixture or transalkylation product of the two is contacted with the metal surfaces of transportation and storage facilities, a significant amount of lead is left deposited in scale and on the metallic surfaces. Upon later using the same facilities for lead-free gasoline the latter product becomes contaminated to an extent which may run as high as about 0.07 gram of lead per gallon. This amount of lead is sufficient to impair the life of exhaust emission control oxidation catalysts.

2. Description of the Prior Art

Techniques have heretofore been known for removal of dissolved or suspended heavy metal contaminants from liquid products.

In catalytic cracking and reforming operations, the use of guard chambers containing a variety of sorbents intended to remove heavy metal contaminant from the charge stock before contact is made with the catalyst have been described.

Systems for removal of lead from gasoline have also been proposed. Presently known techniques require considerable time or are non-selective in effecting removal from the gasoline of those additives which are desired to be retained, such as anti-oxidants, anti-icing additives, metal passivators and the like.

One previously proposing system for removing lead is described in U.S. Pat. No. 2,386,261. There, acid activated clay such as bentonite which has been treated with hydrochloric or sulfuric acid is used. Leaded gasoline is percolated through the clay to remove 95% of the lead present. Acid activated clays will also remove the additives which are required for proper protection and functioning of automotive equipment.

Another approach is that described in U.S. Pat. No. 2,392,846. According to an example in this patent, a five gallon lot of leaded gasoline is treated with 20 ml. of stannic chloride followed by addition of 100 grams of activated carbon. This results in decomposition of the tetraalkyl lead and adsorption of the lead decomposition product on the activated carbon thus drastically reducing the lead content. The gasoline is removed from the activated carbon by decantation. This is a very slow process which permits the processing of about 35 gallons of gasoline per hour. Here also even the additives desired to be retained in the gasoline will also be adsorbed by the activated carbon.

Both the processes described in the cited prior patents depend for effectiveness on a chemical conversion of the tetraalkyl lead. The lead compounds can be reacted with such materials as halogens, halogen acids, metal halides, metal salts, sulfur dioxide, carboxylic acids, metals in the presence of hydrogen, etc. The resulting decomposition products are not readily soluble in hydrocarbons and hence are selectively adsorbed on high surface adsorbents. This avoids the property of tetraalkyl lead moieties which presents the greatest difficulty in this separation, namely infinite solubility in hydrocarbons.

SUMMARY OF THE INVENTION

According to the present invention, sulfur particles ranging in size from a few atoms to a diameter of about 0.1 micron are deposited on solid substrates, such as silicas, aluminas, aluminsilicates, clays, metal oxides, metal sulfides, the surfaces of macroeticular resins and high surface area resins, and polymers containing polar groups such as OH, $SO_3^=$, N and $COO^-$ and the like. The term "macroreticulate resins" is used herein in the sense defined by Kun and Kunin, "Macroreticular Resins, III. Formation of Macroreticular Styrene-Divinylbenzene Copolymers", Journal of Polymer Science, Vol 6, pp. 2689–2701 (1968). Gasoline or other organic fluids are contacted with such active sulfur containing solid substrate under conditions sufficient to produce lead-sulfur reaction products which are then removed from the fluid by electrophoresis. One approach to removal by electrophoresis is based on the method recently discovered for the coalescence of emulsions as described by F. M. Fowles et al., Environ, Sci. Techn. 4,510 (1970). A second approach is based on methodology proposed for the removal of lead particles from engine exhausts discussed in API abstract 70–15118.

In the first referred to method, a bed consisting of two dissimilar particles, for example aluminum and iron, carbon and iron or the like is utilized to produce a high potential difference between particles, e.g., in the order of 100 volts at separations of $10^{-2}$ centimeters. In such an electrical field, colloidal particles, such as the sulfur reaction products produced when leaded fuel is contacted with a sulfur modified substrate, with the usual electrophoretic velocity approximating $10^{-4}$ cm. per sec. per volt per cm. would be plated out in one second. The second approach, dealing with the removal of lead particles from auto exhausts, utilizes aluminum oxide on metal wool and steel wool coated with aluminum.

A third and novel approach based on depositing iron on carbon or other solids, polymers and plastics by electroless deposition could also be utilized. In this way the separation between dissimilar materials would be much smaller and the electric field significantly larger and more effective. Metals and/or metal compounds such as metal oxides or metal sulfides, which are not suitable for electroless deposition, may be chemically exchanged with suitable metals which have been deposited on a solid polymer or plastic through electroless deposition. For purposes of this disclosure, the term dissimilar particles is defined herein so as to include at least two of aluminum, cobalt, iron and carbon.

A novel method of forming or preparing the dissimilar materials described in the aforementioned approaches involves depositing the materials on their substrates in separate and discrete particles rather than in a continuous coating or layer. This method of deposition allows for greater reactivity of the metal particles, as they are not bonded to each other.

In a preferred embodiment of this invention a cartridge of sulfur modified substrate followed by materials suitable for removal of sulfur reactions products by electrophoresis may be placed in a discharge line from a service station pump. The second bed containing such material suitable for removal of sulfur reaction products by electrophoresis may be more particularly defined in a preferred embodiment as follows: said second bed section containing particles of at least two dissimilar metals or metal compounds having an electrochemical potential difference between said particles of a minimum of about 0.1 v. at a distance of 1.0 cm., whereby plating out sulfur reaction products produced in said first bed. This permits utilization of presently installed service station and distribution equipment and avoids the changes in design which would be required if the treating agent were installed in the fill pipe to the local storage tank, in the tank itself, in the suction line to the pump or within the pump housing, all of which alternatives are contemplated within the scope of the invention. A further alternative is placement of the lead removal cartridge in the automotive fuel system between the fuel tank of the vehicle and the carburetor. Flow rates are very small compared to those in bulk and retail distribution equipment, permitting long residence times and small volume cartridges.

BRIEF DESCRIPTION OF THE DRAWING

FIG. 1 of the drawings attached hereto represents a typical service station gasoline pump modified according to the present invention.

FIG. 2 is an enlarged view of the cartridge for containing the lead removal agents.

FIG. 3 is a view in fragmentary section of a cartridge for containing the lead removal agents.

DESCRIPTION OF PREFERRED EMBODIMENTS

As shown in FIG. 1, a gasoline dispensing pump of convention design includes a housing indicated generally at 10 within which are contained a motor driven pump and a metering device, not shown. The metering device drives, through suitable gearing, indicators within a panel 11 to report gasoline dispensed and price for the amount so dispensed. The fuel after passing through the metering device, is conducted to the outside of the housing through a pipe connection 12 and into a discharge hose 13 equipped with a valve nozzle 14.

The modification to convention dispensing pumps is a canister 15 connected to the fuel discharge 12 by a pipe 16 provided with a valve for which the operating handle is shown at 17. Fuel from the pipe 16 is conducted to the top of canister 15 from which it passes through a suitably prepared cartridge and is thence discharged to hose 13 and nozzle 14.

A typical cartridge is shown in FIG. 3 as constituted by a gauze container 18 within a wire mesh supporting case 19. Disposed within the container gauze 18 is a mass of lead removal agents of the type which characterize this invention.

For the usual service station, a cartridge having a diameter of four inches and a length of twelve inches will be adequate to reduce the lead content to acceptable levels for a working life of about one month. When it is desired to change the cartridge, valve 17 is closed, the hose 13 is drained and the canister 15 is removed by unthreading from the top portion thereof. It is thus a simple matter to replace the cartridge in a very short period of time and return the dispensing pump to duty.

A suitable sulfur modified substrate may be prepared according to the following specific examples:

EXAMPLE 1

1 g. of sodium X-type aluminosilicate (13X) is ball milled with 3 g. of powdered sulfur and then heated to fusion temperature. The excess sulfur is removed by further heating until the solids become free flowing.

EXAMPLE 2

1 g. of macroreticular resin such as Amberlite IRA 938 or Amberlite XAD is suspended in 10 ml. of benzene into which $SO_2$ gas followed by $H_2S$ gas is bubbled in, each for a period of 5 minutes or less. The resin is then removed from the benzene by filtration.

EXAMPLE 3

10 cc of a macroreticular resin as prepared according to the procedure of Example 2 is contacted with 50 cc of a gasoline leaded to a level of 0.33 to 0.38 grams of lead/gallon of gasoline. The reacted gasoline is then contacted with 10 cc of material comprising cobalt deposited on carbon through electroless deposition. The method of deposition is as described by Frieze, Said and Well in their article "Some Properties of Electroless Cobalt" published in the Journal of Electrochemical Society: Electrochemical Science at p. 586–91 (June 1968). The lead content of the gasoline following contacting with the mixture of cobalt and carbon would be about 0.03 grams of lead/gallon of gasoline.

The novelty of applicant's invention resides in the combination of a bed of sulfur modified substrate which reacts with metal contaminants in a liquid stream forming sulfur reaction products, and a bed of dissimilar metals or metal derivatives which remove the sulfur reaction products through electrophoresis, as sulfur particles deposited on a solid substrate and electrophoresis are not individually novel per se.

What is claimed is:

1. A method for removing metal contaminants from substantially hydrocarbon streams comprising contacting said substantially hydrocarbon streams with two successive bed sections; said first bed section containing a solid substrate selected from the group consisting of silicas, aluminosilicates, clays, metal oxides, metal sulfides, macroreticular resins, high surface area resins and polymers containing polar groups such as OH, N, $SO_3^=$ and $COO^-$, upon which sulfur particles ranging in size up to an effective diameter of about 0.1 microns are deposited; and said second bed section containing particles comprising at least two of aluminum, cobalt, iron and carbon, whereby sulfur reaction products of said metal contaminants are produced in said first bed section and are plated out on the particles in said second bed section.

2. A method for removing metal contaminants from liquid streams as claimed in claim 1 wherein said solid substrate is a macroreticular resin.

3. A method for removing metal contaminants from liquid streams as claimed in claim 1 wherein said particles of said second bed section are formed by electroless deposition of one of said aluminum, cobalt, iron or carbon on the other.

4. A method for removing metal contaminants from liquid streams as claimed in claim 3 wherein iron is deposited on carbon.

5. A method of removing metal contaminants from liquid streams as claimed in claim 1 wherein each of said aluminum, cobalt, iron or carbon is in a separate and distinct particle.

* * * * *